US005328184A

United States Patent [19]

Antonious

[11] Patent Number: 5,328,184

[45] **Date of Patent: * Jul. 12, 1994**

[54] IRON TYPE GOLF CLUB HEAD WITH IMPROVED WEIGHT CONFIGURATION

[76] Inventor: Anthony J. Antonious, 7738 Calle Facile, Sarasota, Fla. 34238

[ * ] Notice: The portion of the term of this patent subsequent to May 1, 2007 has been disclaimed.

[21] Appl. No.: 938,670

[22] Filed: Sep. 1, 1992

Related U.S. Application Data

[63] Continuation of Ser. No. 647,971, Jan. 30, 1991, abandoned, and a continuation-in-part of Ser. No. 290,903, Dec. 28, 1988, Pat. No. Des. 320,056, and Ser. No. 419,836, Oct. 11, 1989, Pat. No. Des. 327,308.

[51] Int. Cl.[5] ..... A63B 53/04

[52] U.S. Cl. ..... 273/169; 273/173; 273/167 F; 273/167 H; 273/77 A

[58] Field of Search ..... 273/167–175, 273/77 R, 77 A, 164.1, 193 R, 194 R, 187.4, 194 A; D21/214–220

[56] References Cited

U.S. PATENT DOCUMENTS

| | | | |
|---|---|---|---|
| D. 164,596 | 9/1951 | Penna | 273/167 D X |
| D. 164,597 | 9/1951 | Penna | 273/167 D X |
| 1,320,163 | 10/1919 | Maurice | 273/171 |
| 1,582,836 | 4/1926 | Link | 273/167 H |
| 2,087,685 | 7/1937 | Hackney | 273/167 F |
| 3,059,926 | 10/1962 | Johnstone | 273/167 R X |
| 3,814,437 | 6/1974 | Winquist | 273/167 R |
| 3,858,886 | 1/1975 | Cosby | 273/167 F |
| 4,214,754 | 7/1980 | Zebelean | 273/167 H |
| 4,429,879 | 2/1984 | Schmidt | 273/167 H |
| 4,438,931 | 3/1984 | Motomiya | 273/167 H |
| 4,511,145 | 4/1985 | Schmidt | 273/167 H |
| 4,602,787 | 7/1986 | Sugioka et al. | 273/167 H X |
| 4,681,321 | 7/1987 | Chen et al. | 273/167 H |
| 4,715,601 | 12/1987 | Lamanna | 273/77 A |
| 4,826,172 | 5/1989 | Antonious | 273/169 |
| 4,921,252 | 5/1990 | Antonious | 273/164 |
| 5,048,835 | 9/1991 | Gorman | 273/169 X |

OTHER PUBLICATIONS

"Austad's 1991 Spring Golf Catalog", Advertisement for Tour Edition Clubs by Spalding, p. 4.

*Primary Examiner*—Vincent Millin
*Assistant Examiner*—Sebastiano Passaniti
*Attorney, Agent, or Firm*—Nicholas J. Aquilino

[57] ABSTRACT

An iron type golf club head having a peripheral weight and a rear cavity provided with a back-bar mass offset from the center of percussion and integrally formed with the peripheral weight adjacent the top ridge and bottom of the club head.

26 Claims, 4 Drawing Sheets

IRON TYPE GOLF CLUB HEAD WITH IMPROVED WEIGHT CONFIGURATION

This application is a continutation of application Ser. No. 07/647,971, filed Jan. 30, 1991, now abandoned and a continuation-in-part of applications Ser. Nos. 07/290,903, filed Dec. 28, 1988, now U.S. Pat. No. Des. 320,056 and 07/419,836, filed Oct. 11, 1989, now U.S. Pat. No. Des. 327,308.

BACKGROUND OF THE INVENTION

The present invention relates to iron type golf club heads and in particular to a cavity back iron type golf club head with a single back bar weight mass configuration, or a set of such iron type golf club heads.

The majority of peripheral weighted iron type golf club heads are formed with a rear cavity and a peripheral mass distributed around the outer rear edge of the club head at at least the heel, toe and sole portions to more evenly distribute the mass for the purpose of providing a more efficient energy transfer of force to a golf ball being struck off of the center of percussion. These type of club heads represent a significant advance in the state of the art. Other advances in weight distribution have been developed as evidenced by my own U.S. Pat. No. 4,826,172, the patent to Winquist 3,814,437, the patent to Johnstone 3,059,926, the patent to Lamina 4,715,601, and the patent to Cosby 3,858,886 among others. These patents generally stand for the proposition that a mere distribution of weight around the outer periphery does not impart maximum transfer of force to a golf ball struck in and around the center of percussion. The aforementioned patents represent various golf club head structures which made up the state of the weight distribution art in golf club heads.

The present invention uses a selective placement of a single back bar weight mass offset from the center of percussion within the cavity on the rear face of the club head to effectively alter the performance of each club. The invention preferably includes a set of iron type golf club heads having such a single back bar weight, with the position of the back bar weight being varied to provide the most optimum effect for each club head. For example, the single back bar weight may be gradually moved forward from proximate the center of gravity toward the toe portion for middle to long irons (low lofted irons). Conversely, the single back bar weight may be moved back from proximate the center of gravity to the heel portion for the shorter (higher lofted) irons. In each case, the respective club heads will produce a better feeling club which enhances the golfer's ability to obtain more meaningful distance and accuracy for all the irons in a set. The shape of the back-bar weight can be varied to maximize the performance of the club for particular situations or golf swings. The unique weight placement and design of the single back bar weight permits a golfer to obtain the best results from his swing and style and execute various golf swing techniques such as drawing or fading a golf ball, when desired. The various shapes, sizes and locations of the single back bar weights within the back cavity may be altered to produce a set of high performance golf club heads which meet the specific needs of a golfer and thus correct problems encountered in the golf swing of the golfer.

The present invention contemplates a variety of single bar back weight placements as well as a variety of shapes and sizes. In a preferred embodiment, a single bar back weight extends from the peripheral mass adjacent the sole to the peripheral mass adjacent the top ridge within the back cavity. The addition and unique location of the single back bar to a club head significantly alters the center of gravity of an iron type golf club head. The various embodiments contemplated by the present invention permit moving the center of gravity upward toward the top ridge, downward toward the sole, forward toward the toe and backward toward the heel. It is contemplated that the preferred embodiment of the single back bar weight mass may be generally rectangular in shape and either a vertical or sloped configuration. In alternative embodiments, the single back bar may be curved, angled or formed of a variety of geometric shapes. The single back bar weight may be of various widths and sizes and may also incorporate an integral tertiary mass to more precisely concentrate the mass of the club and/or define the exact location of the center of gravity in a particular golf club head.

Among the objects of the present invention are an improved iron type golf club head design or set of iron type golf club heads which maximize energy transferred through a golf ball being struck while maintaining improved control, feel, accuracy and distance. Another object is to provide a golf club head which minimizes variances in a golf ball's flight if the ball is hit off center. Still another object of the invention is to provide an improved set of conventional perimeter weighted golf club heads wherein the center of gravity of the heads may be precisely located from a position toward the toe for the longer irons to a position toward the heel for the shorter irons. Yet another object is to provide iron type golf club heads, and sets of such golf club heads, that are designed to correct particular shortcomings of certain golfers, such as the tendency to hit the ball with the club head open, closed, fat or thin.

These and other objects will become apparent with reference to the following specification and drawings.

DESCRIPTION OF PREFERRED EMBODIMENTS

Figure 1:
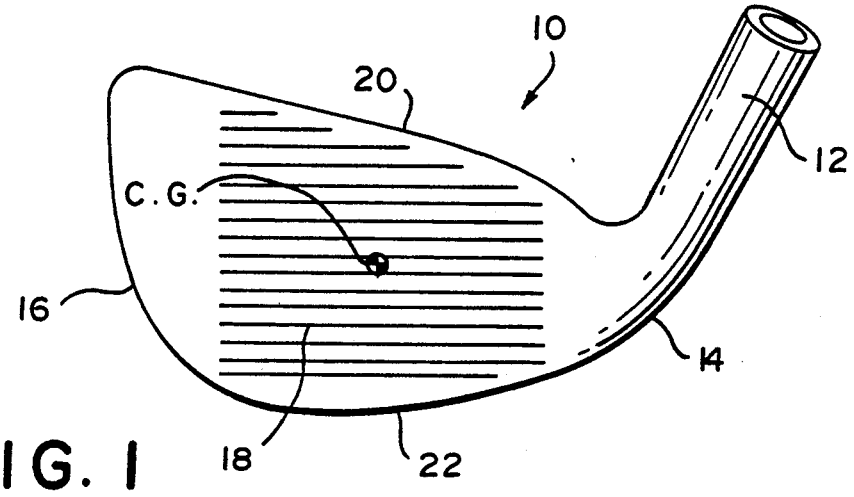
FIG. 1 is a front elevational view of a first embodiment of an iron type of golf club head in accordance with the present invention.
Figure 2:
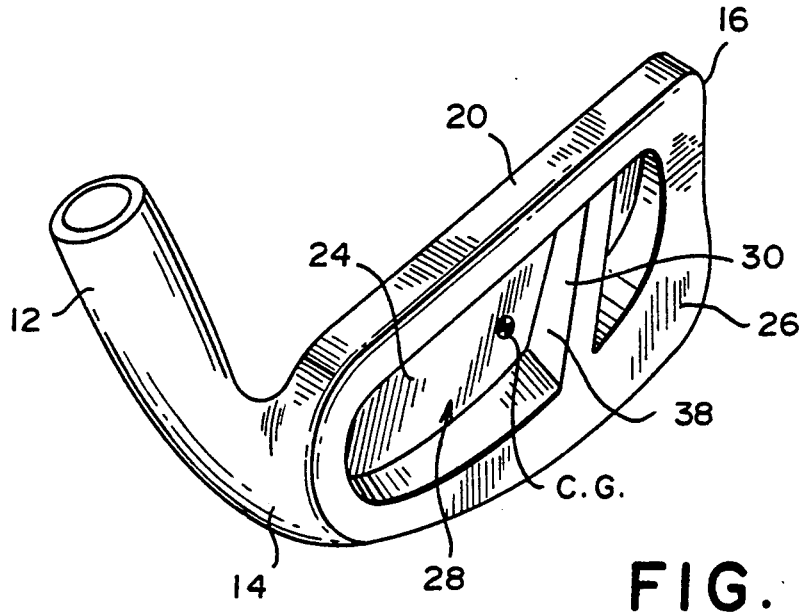
FIG. 2 is a rear perspective view of the club head of FIG. 1.
Figure 3:
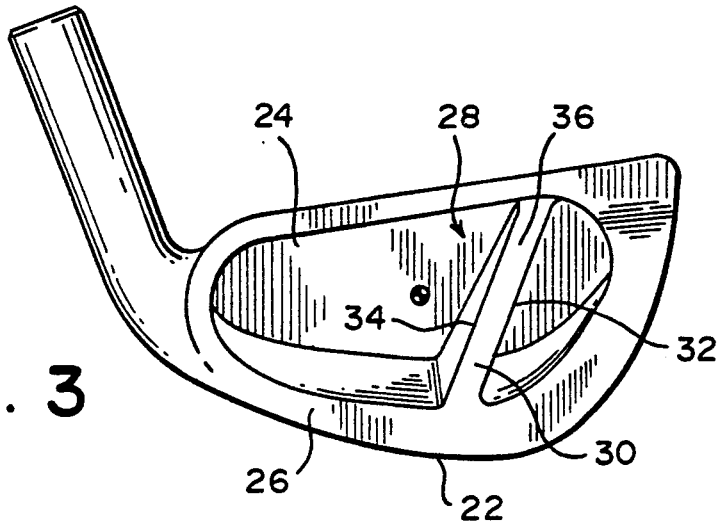
FIG. 3 is a rear elevational view of the club head of FIG. 1.

Referring to the drawings, FIGS. 1-3 show various views of a first embodiment of an iron type golf club head 10 for the present invention. The club head 10 includes a hosel 12, heel 14, toe 16 and ball striking face 18 having a center of percussion CP generally located in the center of the golf club head as shown in the drawings. The club head has an upper surface including a top ridge 20 and a bottom surface including a sole 22. The rear of the club head 10 includes a rear surface 24, an outer peripheral mass 26 and a cavity 28 which is formed by the rearward projection of the peripheral mass from the rear surface 24. In this embodiment, a geometrically shaped back bar mass 30 is integrally formed and connected with the peripheral mass adjacent the sole 22, toward the bottom of the club head and with the peripheral mass adjacent the top ridge 20 toward the top of the club head. The mass 30 is located offset from and adjacent the center of percussion CP and provides a significant mass at its point of location to enhance the energy transfer of a golf ball being struck during the execution of a golf stroke. In the embodiment, as seen in FIG. 3, the back bar weight or mass 30 takes the form of a generally rectangular shaped, elongated bar having parallel side surfaces 32 and 34 and a top surface 33 as shown. In this embodiment, back bar mass 30 is angled slightly toward the toe 16 in the direction from the sole 22 to the top ridge of the club head.

It will be appreciated that the back bar mass 30 may be moved closer to or further from the center of percussion and between the center of percussion and the toe, or may be moved closer to or further from the center of percussion and between the center of percussion and the heel. The reasons for this change in location will be explained below. Both the top surface 33 and side surfaces 32 and 34 of the back bar mass 30 are planar in shape and provide a smooth uniterrupted surface configuration on the rear of a club head.

The back bar mass 30 in this embodiment is inclined from its bottom to its top slightly toward the toe of the club and decreases in thickness (front to back) as it extends upwardly. The width of this bar is substantially uniform along its length. The location of the back bar on the toe side of the club in this particular club tends to assist the golfer in correctly closing the face of the club at the point of impact, when the ball is struck. This is particularly important for the lower lofted clubs (such as the 1, 2, 3, 4, 5 and 6 irons) which are generally swung at higher velocities and have narrower soles than the higher lofted clubs (such as the 8, 9, pitching wedge and sand wedge). On the other hand, the higher lofted club heads typically are swung at a slower rate and have wider soles. For these types of club heads the back bar is located toward the heel, to control the club head and place more mass at the location where most high lofted clubs contact the ball for maximum control and efficiency. Depending upon the particular design of the club head and the back bar, the back bar for a 7 iron may be placed on the toe or heel side of the center of percussion.

Figure 16:
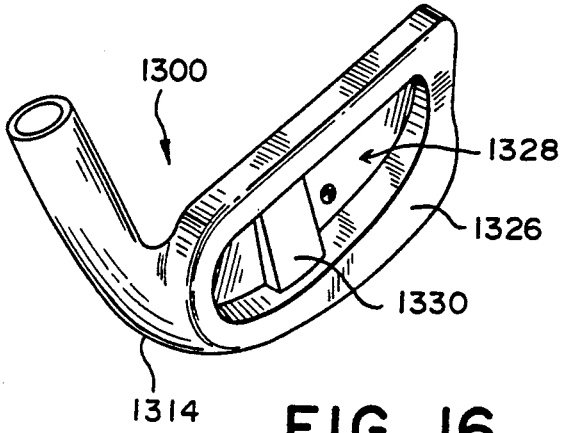
FIG. 16 is a rear perspective view of a fourteenth embodiment of the present invention.
Figure 17:
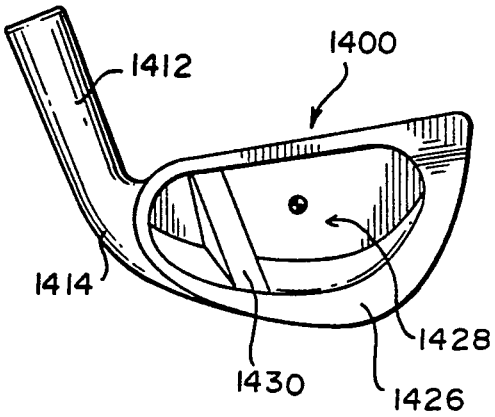
FIG. 17 is a rear perspective view of a fifteenth embodiment of the present invention.

A set of clubs made according to the bar design would include low lofted clubs with the bar on the toe side of the center of percussion or center of gravity (like FIG. 4) and higher lofted clubs with the bar on the heel side of the center of percussion (like FIG. 17). In this design, the predominant weight of the bar is toward the sole, providing more mass at the sole. Club heads having more mass toward the sole are particularly good for golfers who do not hit down into the ball and who therefore hit the ball thin. The bar designs shown in FIGS. 1-3, 4, 6, 7, 8, 11, 14, 15, 16, 17 and 18 all have back bars that provide more weight toward the sole, thereby providing this particular benefit, to varying degrees.

Figure 4:
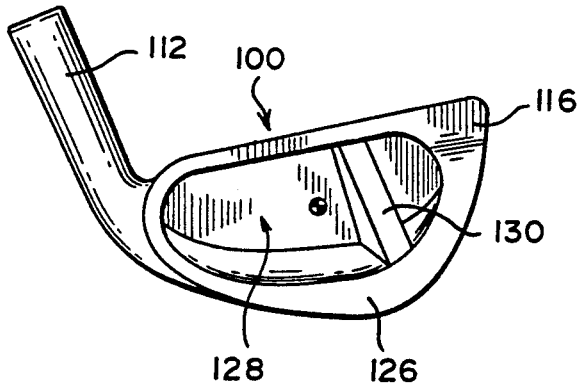
FIG. 4 is a rear elevational view of a second embodiment of the present invention.

FIG. 4 illustrates a second embodiment of a golf club head 100 of the present invention including a peripheral weight 126, a cavity 128 and a back bar mass 130 which is located in the area of the toe 116 and which is positioned parallel to the hosel 112. This design of the back bar mass 130 as compared to the design shown in FIGS. 1-3, places more weight toward the toe of the club and thus increases the tendency of the club to close as it is swung. In addition, the axis of the back bar is aligned with the axis of the hosel (and, therefore, the club shaft). As a result, the club head is better balanced and promotes a smooth swing.

Figure 5:
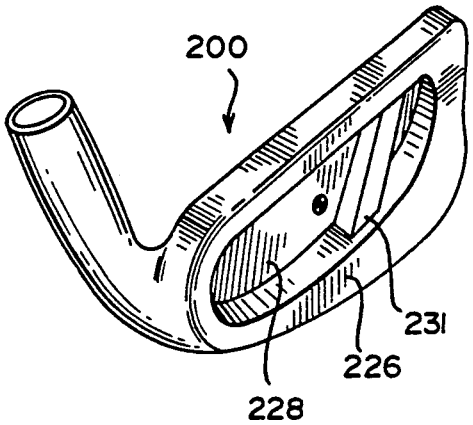
FIG. 5 is a rear elevational view of a third embodiment of the present invention.

FIG. 5 shows a third embodiment of a golf club head 200 including a peripheral weight 226 in rear cavity 228 including a bar back mass 230 in a vertical position having a base 231 recessed within the cavity 228.

Figure 6:
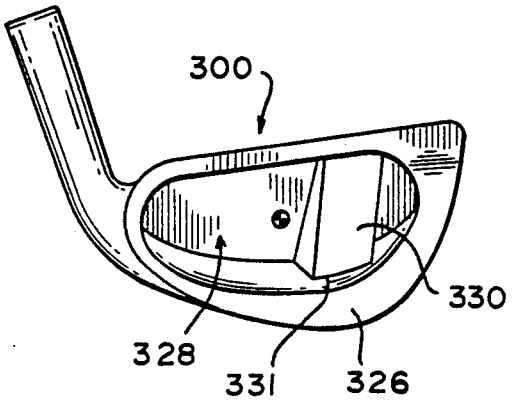
FIG. 6 is a rear elevational view of a fourth embodiment of the present invention.

FIG. 6 shows a third embodiment of a golf club head 300 of the present invention including a peripheral mass 326 in cavity 328 including and having a wide back bar mass 330 with its base recessed within the cavity 328. This back bar mass 330 is also in a generally vertical position relative to the sole for the club head. The axis of the bars shown in FIGS. 5 and 6 are generally perpendicular to the sole of the club head. Designs of this type are particularly appropriate for golfers who stand upright and have fairly straight (up and down) swings, as opposed to a golfer who holds his hands low and has a more flat swing. For a more straight swinger, the vertical bar will be better aligned with the top and bottom of the ball being struck. The recess at the bottom of the bar provides a bar in which the mass is more centrally located and uniform between the CG and toe portion adjacent the sole. This design is best for golfers who tend to hit the ball with the middle (top to bottom) of the club head.

Figure 7:
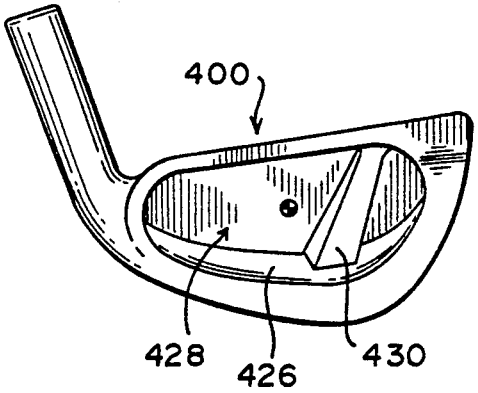
FIG. 7 is a rear elevational view of a fifth embodiment of the present invention.

FIG. 7 shows a fourth embodiment of a golf club head 400 of the present invention including a peripheral weight 426 in cavity 428 including a back bar mass 430 wherein the configuration of the bar tapers upwardly, whereby a greater portion of the mass of the back bar mass 430 is located adjacent the bottom of the club head. This bar design is similar to that shown in FIGS. 1-3, but provides an even greater concentration of mass toward the bottom of the club head.

Figure 8:
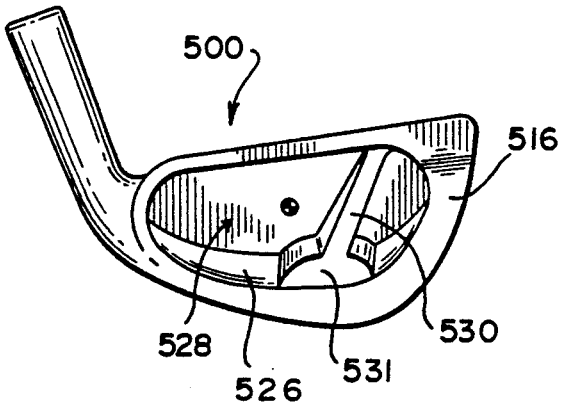
FIG. 8 is a rear elevational view of a sixth embodiment of the present invention.

FIG. 8 illustrates a sixth embodiment of a golf club head 500 in the present invention including a peripheral weight 526 in cavity 528 and a back bar mass 530 located near the toe 516 including a curved weight member 531 integrally formed with the back bar mass 530 adjacent the bottom of the golf club head. This design particularly concentrates mass toward the sole and would be highly effective for golfers that tend to hit the ball thin.

Figure 9:
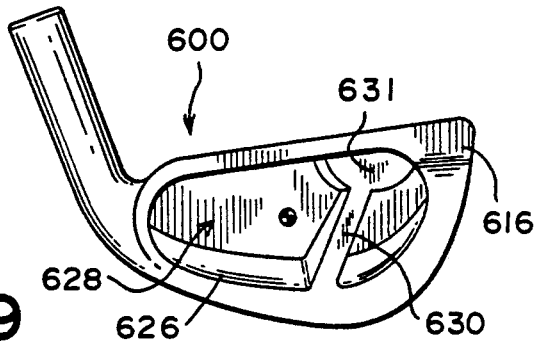
FIG. 9 is a rear elevational view of a seventh embodiment of the present invention.

FIG. 9 shows a seventh embodiment of a golf club head 600 of the present invention including a peripheral mass 626 forming a cavity 628 and having a back bar mass 630 adjacent toe 616 further including a curved weight member 631 integrally formed with the back bar mass 630 adjacent the top of the club head. This design concentrates the mass toward the top and toe of the club head and would be highly effective for a golfer who hits fully down into and through a ball.

Figure 10:
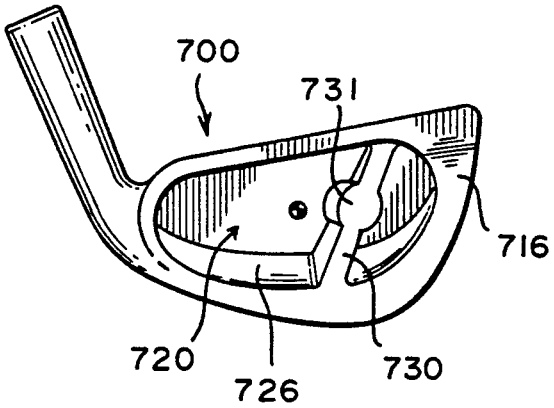
FIG. 10 is a rear elevational view of a eighth embodiment of the present invention.

FIG. 10 illustrates an eighth embodiment of a golf club head 700 of the present invention including a peripheral mass 726, a cavity 728 and a back bar mass 730 adjacent the toe 716. In this embodiment, a cylindrical weight member 731 is centrally disposed and integrally formed with the back bar mass 730. This design concentrates the mass of the single bar approximately at the middle of the club head vertically and would be most effective for a golfer that generally contacts the ball at the area adjacent to and between the CG and the toe 716 of the club head.

Figure 11:
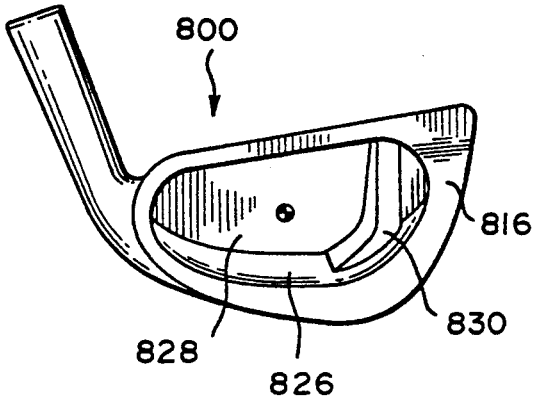
FIG. 11 is a rear elevational view of a ninth embodiment of the present invention.

FIG. 11 illustrates a ninth embodiment of a golf club head 800 of the present invention including a peripheral mass 826 forming a cavity 828 and having a back bar mass 830 adjacent the toe 816 with an added weight mass at the base of the back bar mass 830 sloped toward the center of gravity CG. Such a custom designed bar would tend to force the closing of the face at impact and would be best used by golfers that hit down into the ball and contact the ball generally in the area where the added weight mass is located predominantly adjacent the toe 816.

Figure 12:
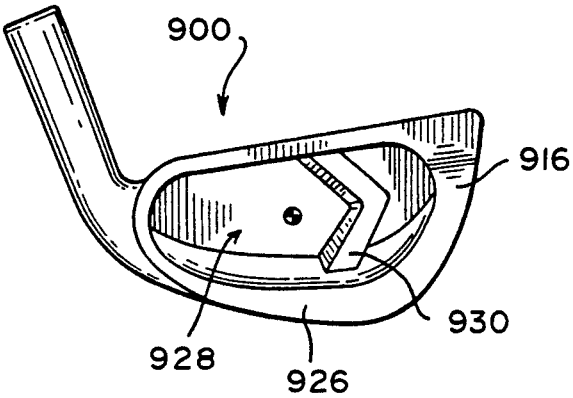
FIG. 12 is a rear elevational view of a tenth embodiment of the present invention.

FIG. 12 shows a tenth embodiment of a golf club head 900 of the present invention including a peripheral weight 926, a cavity 928 and an angular back bar mass 930 angled toward the toe 916 of the club head 900. The angular back bar mass has two angled legs 941 and 942.

Figure 13:
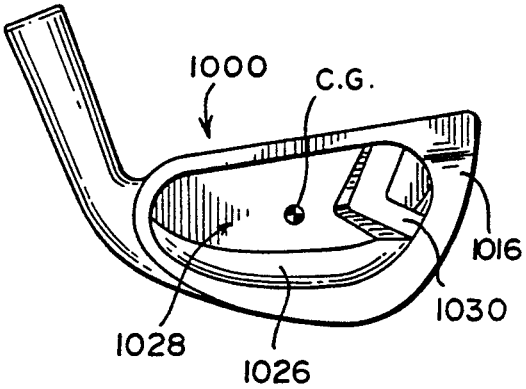
FIG. 13 is a rear elevational view of a eleventh embodiment of the present invention.

FIG. 13 shows an eleventh embodiment of a golf club head 1000 of the present invention including a peripheral weight 1026, a cavity 1028 and a back bar mass 1030 angled away from the toe 1016 toward the center of gravity CG of the club head 1000. Again, the angled back bar mass 1030 has two legs 1041 and 1042. The use of the angled legs lengthens the bar and, therefore, allows the introduction of more mass, for bars having a given width and thickness. The angled approach also allows the more uniform distribution of mass about a point between the angled legs.

Figure 14:
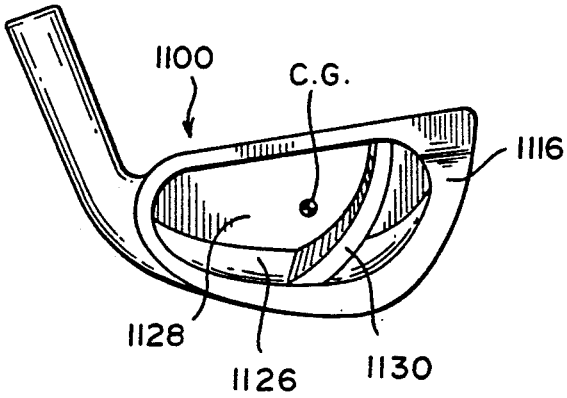
FIG. 14 is a rear elevational view of a twelfth embodiment of the present invention.

FIG. 14 shows a twelfth embodiment of a golf club head 1100 of the present invention including a peripheral mass 1126, a cavity 1128 and a curved back bar mass 1130 located between the toe 1116 and the center of percussion CP or center of gravity CG of the club head 1100. This curved design also lengthens the bar and thus allows the introduction of more mass at the toe area of the club head.

Figure 15:
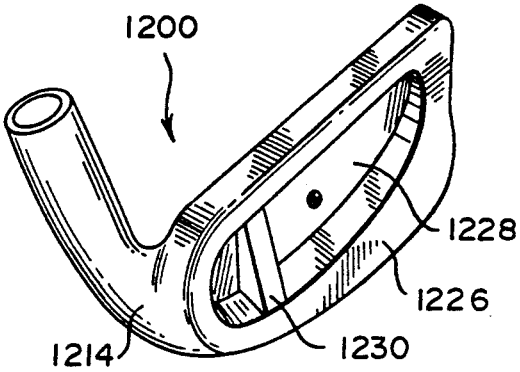
FIG. 15 is a rear elevational view of a thirteenth embodiment of the present invention.

FIG. 15 shows a thirteenth embodiment of a golf club head 1200 of the present invention including a peripheral mass 1226, a cavity 1228 and a back bar mass 1230 located between the heel 1214 and the center of percussion CP.

FIG. 16 shows a fourteenth embodiment of a golf club head 1300 of the present invention including a peripheral weight 1326, a cavity 1328 and a back bar mass 1330 adjacent the heel 1314. The back bar mass 1330 is vertical and relatively wide and recessed within the cavity 1328. The embodiment in FIGS. 15 and 16 are comparable in design to the embodiments shown in FIGS. 5 and 6, respectively, except that the location of the bars is toward the heel rather than toward the toe. Thus, for example, a set of irons would have bars like FIG. 5 for the low lofted clubs and like FIG. 15 for the high lofted clubs.

FIG. 17 shows a fifteenth embodiment of a golf club head 1400 of the present invention including a peripheral mass 1426, a cavity 1428 and a back bar mass 1430 which is located adjacent the heel 1414 and angled so as to be parallel to the hosel 1412. This design is like that shown in FIG. 4, except for higher lofted clubs.

Figure 18:
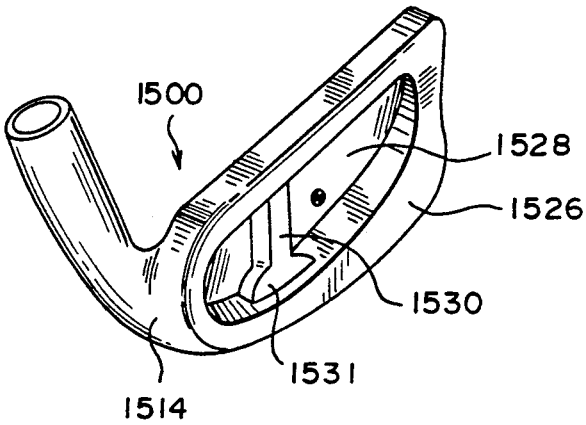
FIG. 18 is a rear elevational view of a sixteenth embodiment of the present invention.

FIG. 18 shows a sixteenth embodiment of a golf club head of the present invention including a peripheral mass 1526, a cavity 1528 and a back bar mass 1530 having a curved weight member integrally formed with the base of the back bar mass 1530 recessed within cavity 1528 and located adjacent the heel 1514 of the club head 1500.

Figure 19:
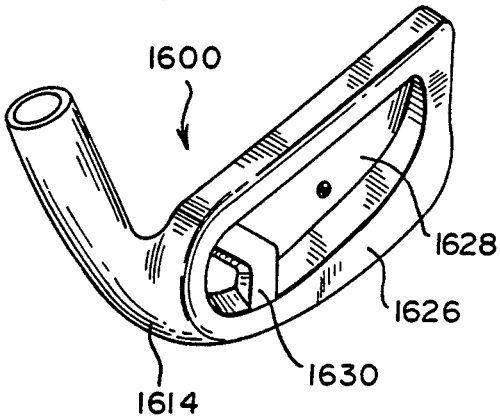
FIG. 19 is a rear elevational view of a seventeenth embodiment of the present invention.

FIG. 19 shows a seventeenth embodiment of a golf club head of the present invention including a peripheral mass 1626, a cavity 1628 and an angled back bar mass 1630 located adjacent the heel 1614 of the club head 1600 and angled away from the heel and toward the center of percussion CP of the club head. This design is like the design shown in FIG. 12, except that the angled bar is located adjacent the heel.

Figure 20:
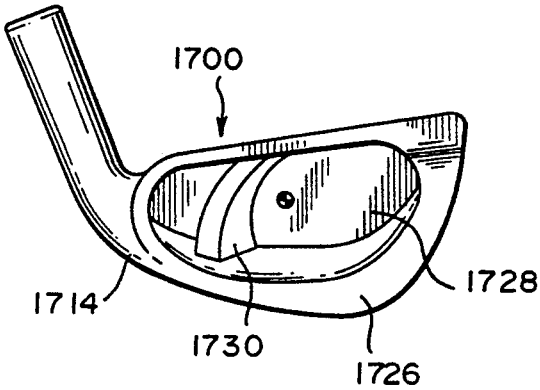
FIG. 20 is a rear elevational view of a eighteenth embodiment of the present invention.

FIG. 20 shows a eighteenth embodiment of a golf club head of the present invention including a peripheral mass 1726, a cavity 1728 and a curved back bar mass 1730 located adjacent the heel 1714 and recessed within the back cavity 1728.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An iron type golf club head for hitting a ball along an intended line of flight, said iron type golf club head comprising:

a hosel, a heel, a toe, a ball striking face, a rear wall opposite said ball striking face, an upper surface including a top ridge, a lower surface including a sole, a center of gravity centrally located relative to said ball striking face, a peripheral masslocated on said rear wall at an outer extremity of said club head, said peripheral mass and said rear wall defining a centrally located cavity formed within said peripheral mass; and a single weight member formed on and attached solely to said rear wall within said cavity, said weight member consisting essentially of a single back bar mass extending between an edge of said peripheral mass located adjacent said lower surface and an edge of said peripheral mass located adjacent said upper surface, said back bar mass being sized to provide a significant mass at its point of location to enhance the energy transfer of a golf ball being struck during the execution of a golf stroke, and said entire back bar mass being offset and completely spaced from the club head's center of gravity.

2. The golf club of head of claim 1, wherein said back bar mass is parallel to said hosel.

3. The golf club head of claim 1, wherein said back bar mass is in a vertical position with respect to said top ridge and said sole.

4. The golf club head of claim 1, wherein said back bar mass includes a base recessed within said cavity.

5. The golf club head of claim 1, wherein said back bar mass tapers upwardly whereby a greater portion of the mass of the back bar is located adjacent said lower surface of said golf club head.

6. The golf club head of claim 1, wherein said back bar mass further includes a curved, geometrically shaped weight member integrally formed with said back bar mass adjacent said lower surface of said club head.

7. The golf club head of claim 1, wherein said back bar mass includes a curved, geometrically shaped weight member integrally formed with said back bar mass adjacent said top ridge of the club head.

8. The golf club head of claim 1, wherein said back bar mass further includes a cylindrical weight member centrally disposed and integrally formed with said back bar mass.

9. The golf club head of claim 1, wherein said back bar mass is thickened adjacent said lower surface.

10. The golf club head of claim 1, wherein said back bar mass is formed with two angularly disposed sections positioned in a direction toward said toe of said club head.

11. The golf club head of claim 1, wherein said back bar member is formed with two angularly disposed sections positioned in a direction toward the center of gravity of the club head.

12. The golf club head of claim 1, wherein said back bar mass is curved.

13. The golf club head of claim 1, wherein said back bar mass is located between said center of gravity and said heel of said club head.

14. The iron type golf club head of claim 1 wherein said back bar mass is generally rectangular in shape, having three exterior, planar surfaces.

15. The iron type golf club head of claim 1 wherein said back bar mass includes two planar surfaces substantially perpendicular to said rear wall.

16. The iron type golf club head of claim 15 wherein said back bar mass includes a third planar surface substantially parallel to said rear wall.

17. The golf club head of claim 1, wherein said back bar mass is located between said center of gravity and said toe of said club head.

18. An iron type golf club head for hitting a ball along an intended line of flight, said golf club head comprising:

a hosel, a heel, a toe, a ball striking face, a rear wall opposite said ball striking face, an upper surface including a top ridge, a lower surface including a sole, a center of gravity centrally located relative to said ball striking face, a peripheral mass located on said rear wall at an outer extremity of said club head, said peripheral mass and said rear wall defining a centrally located cavity formed within said peripheral mass; and a single weight member formed on and attached solely to said rear wall within said cavity, said weight member consisting essentially of a single back bar mass extending between an edge of said peripheral mass located adjacent said lower surface and an edge of said peripheral mass located adjacent said upper surface, said back bar mass being offset from said center of gravity and being sized to provide a significant mass at its point of location to enhance the energy transfer of a golf ball being struck during execution of a golf stroke, and said back bar mass having substantially smooth, uninterrupted surfaces along its length.

19. The golf club head of claim 18 wherein the entire back bar mass is completely offset from the club head's center of gravity.

20. The golf club head of claim 19 wherein said back bar mass includes side walls which are substantially parallel to each other and an outer wall which is substantially parallel to said rear wall.

21. A set of iron type golf club heads for hitting a ball along an intended line of flight, the set comprising:

a plurality of lofted club heads with progressively increasing lofts as the identifying number of the club head increases;

back club head including a hosel, a hell, a toe, a ball striking face, a rear wall opposite said ball striking face, an upper surface including a top ridge, a lower surface including a sole, a center of gravity centrally located relative to said ball striking face, a peripheral mass located on said rear wall at an outer extremity of said club head, said peripheral mass and said rear wall defining a centrally located cavity formed within said peripheral mass;

a single weight member formed on and attached solely to said rear wall within said cavity of each club head, said weight member consisting essentially of a single back bar mass extending between an edge of said peripheral mass located adjacent said lower surface and an edge of said peripheral mass located adjacent said upper surface, said back bar being sized to provide a significant mass at its point of location to enhance the energy transfer of a golf ball being struck during the execution of a golf stroke;

said entire back bar mass on the highest lofted club head of the set being offset and completely spaced from the club head's center of gravity and being located on a heel side of said center of gravity; and the entire back bar mass on the lowest lofted club head being offset and completely spaced from the club head's center of gravity and being located on a toe side of said center of gravity; and the back bar masses in the remaining club heads, starting with the next lowest lofted club head, progressively being located at positions more proximate the heel of the respective club heads as the loft of the club head increases.

22. The set of golf club heads of claim 21 wherein each of said back bar masses has substantially smooth, uninterrupted surfaces along its length.

23. The set of golf club heads of claim 22 wherein each of said back bar masses is substantially rectangular in shape.

24. A set of iron type golf club heads for hitting a ball along an intended line of flight, the set comprising:

a plurality of lofted club heads with progressively increasing lofts as the identifying number of the club head increases;

each club head including a hosel, a heel, a toe, a ball striking face, a rear wall opposite said ball striking face, an upper surface including a top ridge, a lower surface including a sole, a center of gravity centrally located relative to said ball striking face, a peripheral mass located on said rear wall at an outer extremity of said club head, said peripheral mass and said rear wall defining a centrally located cavity formed within said peripheral mass; and a single weight member formed on and attached solely to said rear wall within said cavity of each club head, said weight member consisting essentially of a single back bar mass extending between an edge of said peripheral mass located adjacent said lower surface and an edge of said peripheral mass located adjacent said upper surface, said back bar being sized to provide a significant mass at its point of location to enhance the energy transfer of a golf ball being struck during execution of a golf stroke;

the entire back bar mass on the lowest lofted club head of the set being offset and completely spaced from the club head's center of gravity and being located on an toe side of said center of gravity; and the back bar masses in the remaining club heads, starting with the next lowest lofted club head, progressively being located at positions more proximate the heel of the respective club head as the loft of the club head increases.

25. The set of golf club heads of claim 24 wherein each of said back bar masses has substantially smooth, uninterrupted surfaces along its length.

26. The set of golf club heads of claim 24 wherein each of said back bar masses is substantially rectangular in shape.

* * * * *

US005328184A

REEXAMINATION CERTIFICATE (2659th)

United States Patent [19]

[11] B1 5,328,184

Antonious

[45] Certificate Issued Aug. 22, 1995

[54] IRON TYPE GOLF CLUB HEAD WITH IMPROVED WEIGHT CONFIGURATION

[76] Inventor: Anthony J. Antonious, 7738 Calle Facile, Sarasota, Fla. 34238

Reexamination Request:
No. 90/003,646, Nov. 28, 1994

Reexamination Certificate for:

| | |
|---|---|
| Patent No.: | **5,328,184** |
| Issued: | **Jul. 12, 1994** |
| Appl. No.: | **938,670** |
| Filed: | **Sep. 1, 1992** |

Related U.S. Application Data

[63] Continuation-in-part of Ser. No. 647,971, Jan. 30, 1991, abandoned, and a continuation-in-part of Ser. No. 290,903, Dec. 28, 1988, Pat. No. Des. 320,056, and a continuation-in-part of Ser. No. 419,836, Oct. 11, 1989, Pat. No. Des. 327,308.

[51] Int. Cl.[6] ..... A63B 53/04

[52] U.S. Cl. ..... 273/169; 273/173; 273/167 F; 273/167 H; 273/77 A

[58] Field of Search ..... 273/167–175, 273/77 R, 77 A, 164.1, 193 R, 194 R, 187.4, 194 A; D21/214, 215, 216, 217, 218, 219, 220

[56] References Cited

U.S. PATENT DOCUMENTS 5,048,835 9/1991 Gorman ..... 273/167 F

OTHER PUBLICATIONS

"PGA Gold—1982 Equipment and Apparel": Cover and pertinent pages re PGA Emblem clubs.
"Gold Equipment Universal '84": pp. 421 and 573, with English translation (Japanese).

*Primary Examiner*—Sebastiano Passaniti

[57] ABSTRACT

An iron type golf club head having a peripheral weight and a rear cavity provided with a back-bar mass offset from the center of percussion and integrally formed with the peripheral weight adjacent the top ridge and bottom of the club head.

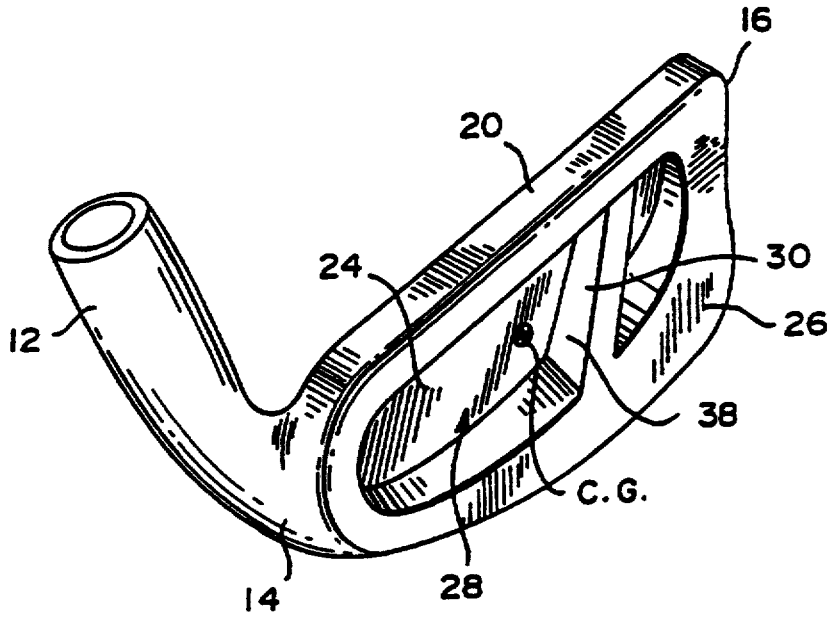

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-26 is confirmed.

* * * * *